United States Patent [19]

Christman

[11] Patent Number: 4,955,619

[45] Date of Patent: Sep. 11, 1990

[54] CARD GAME APPARATUS AND METHOD

[76] Inventor: Robert R. Christman, 1135 N. Frederic St., Burbank, Calif. 91505

[21] Appl. No.: 390,973

[22] Filed: Aug. 7, 1989

[51] Int. Cl.[5] ..... A63F 3/06

[52] U.S. Cl. ..... 273/273; 273/271; 273/303

[58] Field of Search ..... 273/273, 271, 303, 306

[56] References Cited

U.S. PATENT DOCUMENTS

| | | | |
|---|---|---|---|
| 1,564,746 | 12/1925 | Barnard | 273/271 |
| 4,344,627 | 8/1982 | Jones et al. | 273/273 |
| 4,848,768 | 7/1989 | Barlow | 273/273 X |

*Primary Examiner*—Edward M. Coven
*Assistant Examiner*—Raleigh W. Chin
*Attorney, Agent, or Firm*—Leon Gilden

[57] ABSTRACT

A card game apparatus and method is set forth utilizing four sets of playing cards comprising fifty-two cards each plus four wild cards. Each of the four sets is of a single suit, i.e. clubs, diamonds, spades and hearts. A fifth deck of fifty-two cards provide instructional cards involving a "give and take" to effect playing of various cards awarded in a turn. Points are awarded for fulfilling various requirements and a winner derived by attaining an ultimate point total.

4 Claims, 2 Drawing Sheets

CARD GAME APPARATUS AND METHOD

BACKGROUND OF THE INVENTION

1. Field of the Invention

The field of invention relates to playing cards, and more particularly pertains to a new and improved game card playing apparatus wherein the same utilizes single-suit decks of playing cards, as well as a further deck of instructional cards.

2. Description of the Prior Art

The use of various card playing apparatus is well known in the prior art. Various combinations of playing cards and game boards has been set forth, but has heretofore failed to provide the inter-relationship of single-suit decks of cards in combination with particular set of instructional cards, as set forth by the instant invention. For example, the prior art includes U.S. Pat. No. 2,432,248 to Milone wherein game cards are confined within structure to minimize and eliminate the use of "loose" playing cards.

U.S. Design Pat. No. 248,252 to Talley, et al., sets forth a deck of playing cards illustrating an ornamental configuration.

U.S. Pat. No. 3,734,510 to Breslow provides for a card game utilizing tokens associated with cards and notes for playing the cards. wherein solutions are depicted to problem situations. with each solution on each card being denoted by different key indicia.

U.S. Pat. No. 4,440,898 to Charon provides a card game utilizing fifty-two cards wherein six distinct groups of cards are disclosed. Every card of a group has upon its face a distinctive indicia, wherein five eight card groups have indicia such that the five groups may be sequentially ordered, either by numbering or some other coding format, wherein each player is dealt two cards with a third card to be dealt to each player having a hand which qualifies for continuing play according to a predetermined qualifying standard.

U.S. Pat. No. 1,775,782 to Pearson sets forth a card game wherein a deck of cards composed of a number of different suits may be employed to play various of the games, wherein the cards of each group bearing actual numerical designation of a capturing power relative to an associated group, wherein players must follow suit in the playing of the game that utilizes taking values of cards and trump values of cards.

As such, it may be appreciated that there is a continuing need for a new and improved card game apparatus and method wherein the same may utilize various decks of single-suit cards in association with instructional cards for effecting a novel and amusing play of cards among a plurality of participants.

SUMMARY OF THE INVENTION

In view of the foregoing disadvantages inherent in the known types of card game apparatus and methods now present in the prior art, the present invention provides a card game apparatus and method wherein the same utilizes a series of uni-suit decks of playing cards to include all four conventional heart, club, diamond, and spade cards, and further including a fifth directional card deck to effect an element of chance into the playing of the game. As such, the general purpose of the present invention, which will be described subsequently in greater detail, is to provide a new and improved card game apparatus and method which has all the advantages of the prior art card games and none of the disadvantages.

To attain this, the card game apparatus and method of the instant invention essentially includes a playing field comprising a board with four positions to include an ace through king series of spaces defining a set, wherein each space is of a general configuration in conformity with the geometric outline of an associated playing card. Four such series are aligned adjacent four sides of the playing card with a central spacing positioned medially of the four player positions to provide a space for the diamond deck, the spade deck, the heart deck, and the club deck with adjacent diamond, spade, heart, and club secondary spaces for receiving discarded cards thereon. A plurality of central spaces are further utilized to provide a space for the directional card deck with a secondary adjoining space for receiving discarded card from the directional card deck. Upon determining an initial player, the player participants, to include two to four players, attempt to fill out the consecutive spacing (or set) adjacent a player position without positioning consecutive cards of a like suit adjacent one another. Wild cards are also utilized to effect this object with directional "give and take" cards controlling the scoring to include completing player sets, ending a game, points for each card played, and the like. Each single-suit deck of cards includes fifty-six cards to include four wild cards with the fifth directional deck to include fifty-two directional cards of various directions imparted upon each card.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved card game apparatus and method which has all the advantages of the prior art card games and none of the disadvantages.

It is another object of the present invention to provide a new and improved card game apparatus and method which may be easily and efficiently manufactured and marketed.

It is a further object of the present invention to provide a new and improved card game apparatus and method which is of a durable and reliable construction.

An even further object of the present invention is to provide a new and improved card game apparatus and method which is susceptible of a low cost of manufacture with regard to both materials and labor, and which accordingly is then susceptible of low prices of sale to the consuming public, thereby making such card game apparatus and methods economically available to the buying public.

Still yet another object of the present invention is to provide a new and improved card game apparatus and method which provides in the apparatuses and methods of the prior art some of the advantages thereof, while simultaneously overcoming some of the disadvantages normally associated therewith.

Still another object of the present invention is to provide a new and improved card game apparat us and method wherein the same utilizes multiple single-suit decks of cards in conjunction with a directional deck of card to effect point scoring and playing of the game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
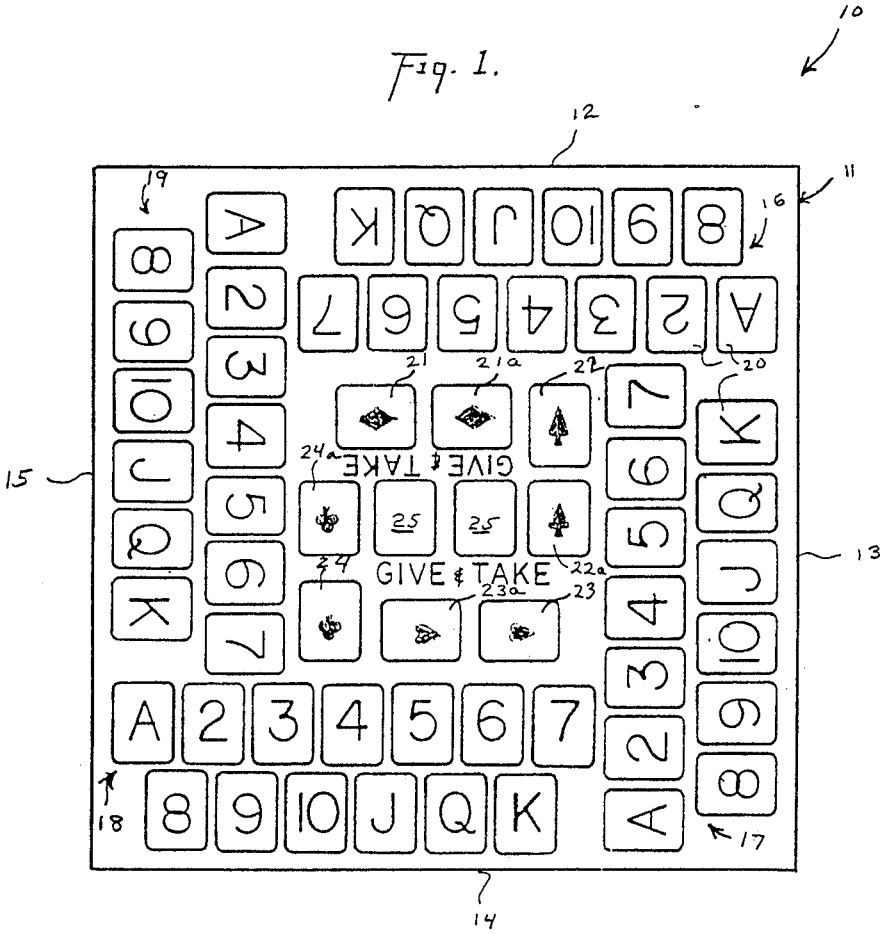
FIG. 1 is a top orthographic view of the playing field of the instant invention.

With reference now to the drawings, and in particular to FIGS. 1 to 4 thereof, a new and improved card game apparatus and method embodying the principles and concepts of the present invention and generally designated by the reference numeral 10 will be described.

Figure 2:
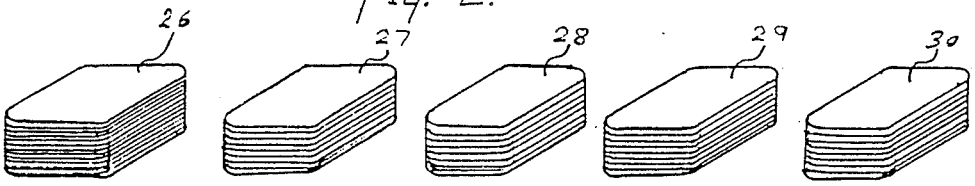
FIG. 2 is an orthographic vie illustrating the five decks of cards utilized by the instant invention.

More specifically, the card game apparatus and method 10 of the instant invention essentially comprises a square game board 11 formed with respective first, second, third, and fourth player positions 12, 18, 14, and 15 positioned in alignment with the four respective sides of the square game board 11. A first, second, third, and fourth player set of respective numeral designations 16, 17, 18, and 19 comprise thirteen rectangular spaces of rectangular configuration to equal and accommodate a playing card of the decks of playing cards, to be described in more detail below. The spaces are designated with an ace, a two, a three, a four, a five, a six, a seven, an eight, a nine, a ten, a jack, a queen, and king designation spaces to indicate a player set. The card spaces 20 so arranged are positioned with seven of the card spaces 20 overlying six card spaces below, wherein the six card spaces below are off-set one-half space relative to the card spaces above to symmetrically orient the top and bottom rows comprising the player sets of thirteen card spaces 20. The card space 20 of the player sets are off-set relative to the left portion of a respective player position, wherein the right-hand portion of the player position receives a right-hand player's card set in orthogonal relationship. The central portion of the game board 11 includes ten additional card spaces with an arrangement in a generally rectangular pattern. Corner spaces 21, 22, 20, and 24 respectively include the spaces that comprise diamond deck space 21, the spade deck space 22, the heart deck space 28, and the club deck space 24. Adjacent spaces 21*a*, 22*a*, 28*a*, and 24*a* positioned medially of the perimeter of the rectangular arrangement of the central card spaces are for discards of the respective diamond, spade, heart, and club decks. A plurality of central spaces 25 are provided to receive within one of the said spaces 25 a directional card deck with the adjacent directional card space to receive discarded cards from the directional card deck. The card decks are illustrated in FIG. 2 as the first diamond deck 26, the second spade deck 27, the third heart deck 28, and the fourth club deck 29. The deck 80 is a "give and take" directional card deck to be positioned in one of the spaces 25, as noted above. The various decks 26 through 29 are comprised of a single suit, and therefore the designation that all of the cards within the deck are of a typical diamond or a spade designation for example, as would be the case with the decks 26 and 27. Each of the suit decks 26 through 29 comprise fifty-six cards wherein fifty-two conventional cards are utilized of a single suit from the use of four twos through the use of four aces to provide fifty-two cards, and such decks further include four wild card cards to thereby comprise fifty-six cards. The directional deck 30 utilizes fifty-two cards. To achieve the four unitary suit decks, four conventional card decks are utilized and are then segregated into separate suits to provide the decks 26 through 29 as utilized by the game of the instant invention.

Figure 3:
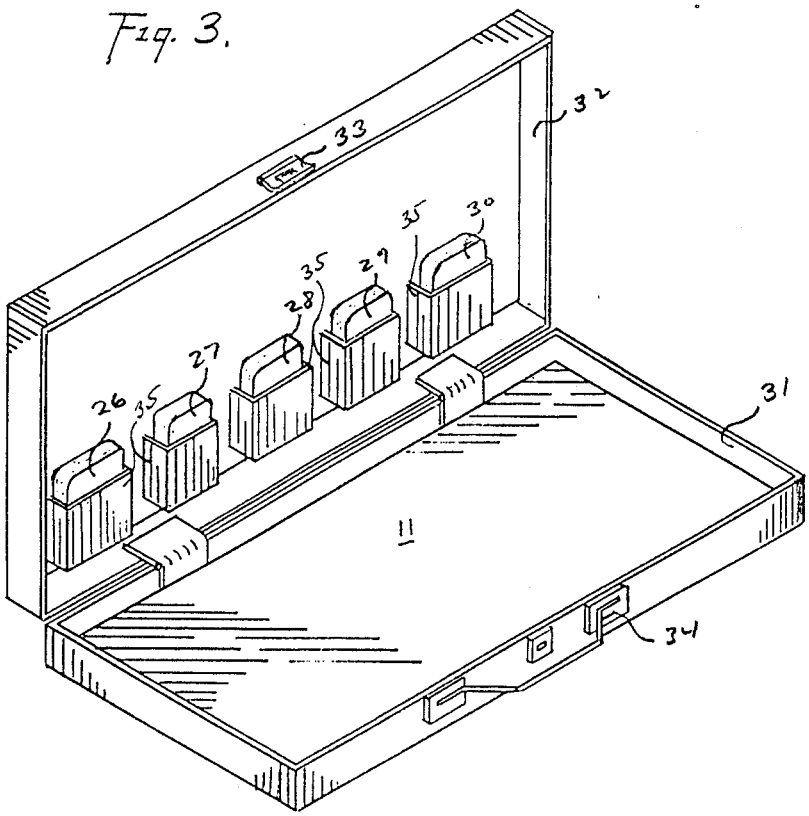
FIG. 3 is an isometric illustration of the instant invention secured within a carrying case.
Figure 4:
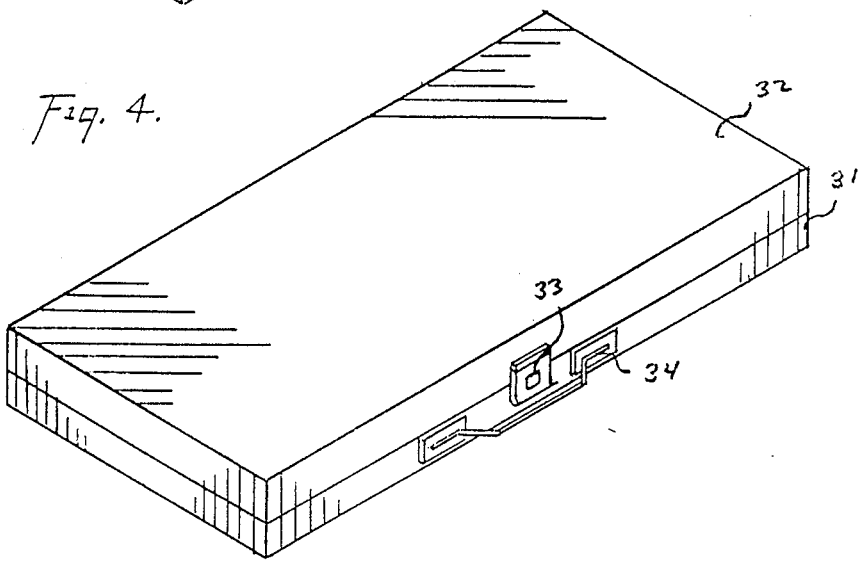
FIG. 4 is an isometric illustration of the carrying case of FIG. 8 in a closed configuration.

FIG. 3 is illustrative of a carrying case utilized by the game of the instant invention comprising a bottom receptacle 31 and a pivotally mounted top receptacle portion 32 with an intercommunicating latch 00 between the bottom and top receptacle portions 31 and 32 with a handle 34 positioned on a forward face of the bottom receptacle 32. A series of five pockets 35 are positioned within an interior surface of the top receptacle 32 for reception of the decks 26 through 30.

Initially, the decks 25 through 30 are shuffled and positioned on their respective designated spaces 21 through 25 respectively with &he adjacent spaces 21*a*, 22*a*, 23*a*, 24*a*, and 25*a* positioned for discards of the respective decks, as noted. A lead player is determined wherein a player draws a card from a choice of decks with a high card winning. A wild card drawn during this procedure is returned to the deck as it has no value in determining a lead player. The lead player then, in a clockwise manner, draws four cards from each of the respective decks 26 through 29, with a subsequent result of sixteen cards provided for each player. Optionally, each player may take a single suit deck when four players are available and beginning with the lead player will deal four cards to each player, such that each player begins with four cards of each suit from each of the respective decks 26 through 29.

An opening or "free play" consists of at least four consecutive cards using a player's portion of the playing field referred to as the set 16 through 19. To position adjacent cards, no consecutive cards may be of the same suit referred to as the "suit adjacency rule". I E., no heart may be played next to an adjacent heart and the like. This "suit adjacency rule" also applies to the ace-king relationship as an opening play or "free play" could be of a queen, king, ace, two relationship. If any players opening or "free play" using the sixteen cards awarded ends the hand, scoring is awarded at that juncture, to be discussed in more detail below. If a player is not able to position four cards adjacent one another with regard to the "suit adjacency rule", that player must pass to the next player in a clock-wise manner and that next player must then follow the "four card rule" to position four cards adjacent one another without utilizing cards of a same suit. A wild card from any of the decks may be utilized to fulfill a consecutive card suit relationship.

The wild cards have multiple applications and may be utilized to position a needed card in constructing four adjacent cards for consecutive play. No more than two "wild cards" may be visible on a player's field or set at any given time. A wild card is also retrievable such that upon subsequent play, a card is drawn that a wild card is positioned upon a player's set, that wild card may be withdrawn and the drawn card substituted therefore. Further, a wild card may also be lost on a play involving a "give" card from the instructional and directional "give and take" deck 30. At any time during the playing of the game, cards may be added on top of played cards positioned within the spaces. For example after playing opening cards, an ace of clubs may be positioned over an ace of spades thereby clarifying a suit adjacency problem if an ace of spades is positioned next to a two of spades. A complete set is only available within the sets 16 through 19 when suit adjacency rule is adhered to provide a scoring goal. Multiple sets may be made making scores greater where playing cards may be positioned on top of playing cards already positioned within the spaces 20 of a player's set. Any number of cards may be played on &op of already played cards within the set, such as having seven cards on the eighth space of the spaces 20.

Regarding the "four card rule" on all plays after opening player's free play, the four card rule applies which means that any number of cards up to a total of four may be dealt with a given turn. An exception involves a possible two cards played to end a hand involving the "give and take" cards of the deck 30. For example, a "give and take" card may instruct a player to give or take two cards. This results in allowing two cards of a four card play to be utilized in the playing field. A fur&her example would involve a give and take card instructing the player to take one card of each suit. That would result in four cards being involved in a total turn. A yet further example would involve a replacement of a wild card with a natural card. That would involve two plays i.e.. one to return the wild card to the hand of the player and the second play to involve the placement of the natural card. This play could be made without drawing a "give and take" card from the deck 30 and allow a player to field two more cards. This play could also be made with a "give and take" card of the deck 30 involving only a two card demand. A further example of the four card rule would involve effecting a one, two, three, or four card play without drawing a "give and take" card. I.E., if you cannot or do not want to effect a field play on a respective one of the sets 16 through 19, a "give and take" card from the deck 30 must be drawn. The card instructions and directions must be expedited, if possible, in the same turn as the draw of that card.

As to the "give and take" cards of the deck 30, the cards upon being drawn are positioned face up on adjacent space 25 of the "give and take" deck 30. A number of "give" cards are provided within the deck 80. "Give" card instructions must be fulfilled prior to effecting additional plays wherein the "give" cards require the giving of cards from the cards held by a player. For example, a "give" card instructs the giving of a heart or a diamond. That player drawing that particular card must return a choice of hearts or diamonds to complete the instruction, however, if the player cannot fulfill a "give" card's instructions completely, that player must pass and no further play may be effected by that player's turn.

A further example utilizing the "give and take" cards of the deck 30 involves a "give" card instructing a player to give a heart and a diamond. If the player has diamonds but no hearts but a wild card is available, that player would then return the diamond of choice and an associated wild card in place of the heart to the heart discard pile.

A further example utilizing "give and take" cards would involve a situation where none of the "give" card's demands are available to the player but two wild cards are, then those two wild cards may be utilized to fulfill the "give" card's commands.

A further example of utilization of the "give and take" cards involves a "give" card instruction to give a club and a spade and the player has only one card remaining, such as a club. That player could end the hand by returning the club and further drawing a spade from the respective set of that player, i.e. 16 through 19. It should be noted that taking a card from a player's set or playing field may not result in the producing of a suit adjacency problem as noted in the instructions at the outset of the game, and the ending of a hand is the only condition under which a card may be returned from a player's playing field or set.

As to the "take" cards, these cards result in instructions to taking of cards from the top of respective suit decks or from the last cards discarded by an adjacent player having discarded a card onto one of the spaces **21*a* through 24*a*. An example involves a "take" card instructing a playing to take one card from each suit, wherein this player may take a top card from a discard pile 21*a* through 24*a* or from the top of the deck piles 21 through 24**.

The "give and take" cards comprising the instructional cards are as follows:

Give (3); take (3); one heart and one diamond-six cards.
Give (3); take (3); one heart and one spade-six cards.
Give (3); take (3); one heart and one club-six cards.
Give (3); take (3); one club and one spade-six cards.
Give (3); take (3); one club and one diamond-six cards.
Give (3): take (3): one spade and one diamond-six cards.
Give (2): take (2): two cards of each suit-eight cards.
Take (only) one of each suit-eight cards.
Total: fifty-two cards.

In winning, a winner is determined by the first player to reach predetermined point total such as 600 for example. This point total should typically involve more than one hand of play. A hand ends when a player tables all of a respective player's cards, either by scoring or by turning last cards held remote from the sets 16 through 19. The cards are sorted by suit and all decks including the "give and take" deck 80 are reshuffled for the next hand to begin with the player who ended the last hand.

In scoring, a score of ttwenty-five points is awarded for a player ending a hand. A score of twenty-five points is awarded for each complete set of ace through king. Additionally, a score of one point is awarded for every card played, wherein wild cards have the same value as the other cards. One point is deducted for each card held when a hand has been ended by a respective winning player. For example, a respective player ended the hand by returning all cards remote from the set 16 throuGh 19, and an award of twenty-five points plus one point for each point played. A further example would involve if four cards were held when the score ended, but that player had a complete set, the score would be twenty-five points for the set minus four points for the cards remaining plus thirty cards played for thirty additional points would result in a total score of fifty-one points. A fur&her example involves if a respective player held ten cards when the hand ended but two complete sets were effected by that player, that player would be awarded twenty-five points for each of the two sets plus forty points for forty cards played minus ten points for the ten cards remaininG in that player's possession for a total score of eighty points.

A yet further example would involve a player having used all sixteen cards on an opening free play and an adjacent player could not open with at least four consecutive cards not violating the adjacency rule, and had to pass, that player's score would be minus sixteen points or one point deducted for each of the sixteen cards held by that player from the initial draw.

An option in the playing of the game would involve playing with partners where the rules for individual play would remain but that only one set per pair of partners would be utilized. i.e., if four players were involved resulting in two sets of partners, only two playing fields or sets would be utilized of the set 16 through 19.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of playing a card game including a plurality of players comprising the steps of, (a) providing a game board and forming four player stations on said game board, and (b) providing four decks of playing cards wherein each of said four decks each includes an equal first predetermined number of playing cards, and (c) providing a fifth directional card deck of playing cards of a second predetermined number of playing cards contained wherein said second predetermined number is formed less than said first predetermined number, and (d) directing each of said players to arrange said playing cards upon available spaces formed on said game board, and wherein (b) further includes the step of obtaining said four decks of playing cards to each included cards of the suits including diamonds, hearts, clubs, and spades, and further including the step of segregating each of said suits to form each of said decks of a single suit different from a subsequent deck of said four decks of playing cards, and additionally including the steps of adding four wild cards to each of said decks.

2. A method of playing a card game as set forth in claim 1 wherein step (e) includes directing each player to arrange the sequentially dealt cards of said third predetermined number upon said available spaces such that adjacent cards are of a different suit of said four suits to include diamonds, clubs, hearts, and spades.

3. A method of playing a card game as set forth in claim 2 wherein said fifth deck of cards is provided to include fifty-two cards, and said cards are formed to include directions to take from and give cards to said four decks.

4. A method of playing a card game as set forth in claim 3 wherein step (a) further includes the step of forming said game board in a square configuration, and forming thirteen spaces to define said available spaces for each player, and arranging said thirteen spaces to include seven spaces overlying six spaces positioned medially under said seven spaces, and positioning said thirteen available spaces adjacent a left side of said playing board for each of said player station, and further forming a rectangular configuration of further available spaces medially of said available spaces, wherein said further available spaces are arranged to include two spaces for each of said four decks of playing cards to define a perimeter about two spaces formed medially, wherein said two spaces formed medially accommodates said fifth deck of playing cards.

* * * * *